US006929535B2

(12) United States Patent
Smith et al.

(10) Patent No.: US 6,929,535 B2
(45) Date of Patent: Aug. 16, 2005

(54) APPARATUS AND METHOD FOR DEGRADING THE INFORMATION BEARING CAPABILITIES OF A DISK

(75) Inventors: Carlo Smith, La Jolla, CA (US); Les Kollegian, La Jolla, CA (US)

(73) Assignee: Disc Dealer Inc., San Diego, CA (US)

( * ) Notice: Subject to any disclaimer, the term of this patent is extended or adjusted under 35 U.S.C. 154(b) by 0 days.

(21) Appl. No.: 10/605,158

(22) Filed: Sep. 11, 2003

(65) Prior Publication Data

US 2004/0116053 A1 Jun. 17, 2004

(51) Int. Cl.[7] ..... B24B 1/00

(52) U.S. Cl. ..... 451/41; 451/57; 451/290; 451/540

(58) Field of Search ..... 451/28, 41, 57, 451/59, 63, 285, 287, 290, 540, 557

(56) References Cited

U.S. PATENT DOCUMENTS

| | | | | | |
|---|---|---|---|---|---|
| 5,099,618 | A | * | 3/1992 | Schmid | 451/57 |
| 5,146,382 | A | * | 9/1992 | Yao-Ko | 360/137 |
| 5,571,041 | A | * | 11/1996 | Leikam | 451/37 |
| 5,954,569 | A | | 9/1999 | Hutchinson et al. | |
| 5,964,650 | A | * | 10/1999 | Born et al. | 451/63 |
| 6,039,637 | A | * | 3/2000 | Hutchison et al. | 451/271 |
| 6,312,320 | B2 | * | 11/2001 | Sato et al. | 451/285 |
| 6,322,430 | B1 | * | 11/2001 | Kennedy et al. | 451/287 |
| 6,638,149 | B2 | * | 10/2003 | Lalli et al. | 451/63 |
| 2003/0006330 | A1 | | 1/2003 | Chang | |
| 2004/0014404 | A1 | * | 1/2004 | Miller | 451/63 |

OTHER PUBLICATIONS

CDestroyer—product page attached and found at: http://www.medeainternational.com/acatalog/PressIt.html.

* cited by examiner

*Primary Examiner*—David B. Thomas
(74) *Attorney, Agent, or Firm*—Dalina Law Group P.C.

(57) ABSTRACT

Embodiments of the invention abrade the information bearing surface of a compact disc (CD), DVD or other digital information bearing disk, in order to render it unreadable by standard consumer grade disk readers. This is accomplished via embodiments of the invention that are extremely lightweight, highly portable and inexpensive. Embodiments may or may not employ an outer case in order to retain the remnants of the abraded information layer of the disk. In order to operate one embodiment of the invention, the apparatus is opened and a compact disc is inserted with the face of the disk against the abrasive mechanism. After closing the apparatus, the outer housing of the apparatus is rotated with sufficient pressure against the abrasive mechanism in order to cause the substrate to be damaged sufficiently to render it unreadable by consumer based disk readers. The apparatus can be opened over a trash bin in order to empty both the disk and the particulate matter generated by the abrasive process. The apparatus may be rotated by hand or by motor in various embodiments. A case-less embodiment of the invention exists that comprises the abrasive mechanism and a post that fits into the center hole of the disk. Since there is no outer case coupled to the apparatus in this embodiment, the embodiment may be held over a trash bin while abrading the disk in order to dispose of the particulate matter resulting from the abrading process. In order to operate this embodiment, a disk is inserted into the opening between the abrader and post supporter and the post engages the hole in the center of the disk. The disk is then rotated in order to abrade the information bearing portion of the disk. When the disk has been abraded to the satisfaction of the user, the disk is disengaged from the post and the disk is removed and disposed of.

13 Claims, 8 Drawing Sheets

Fig. 6A
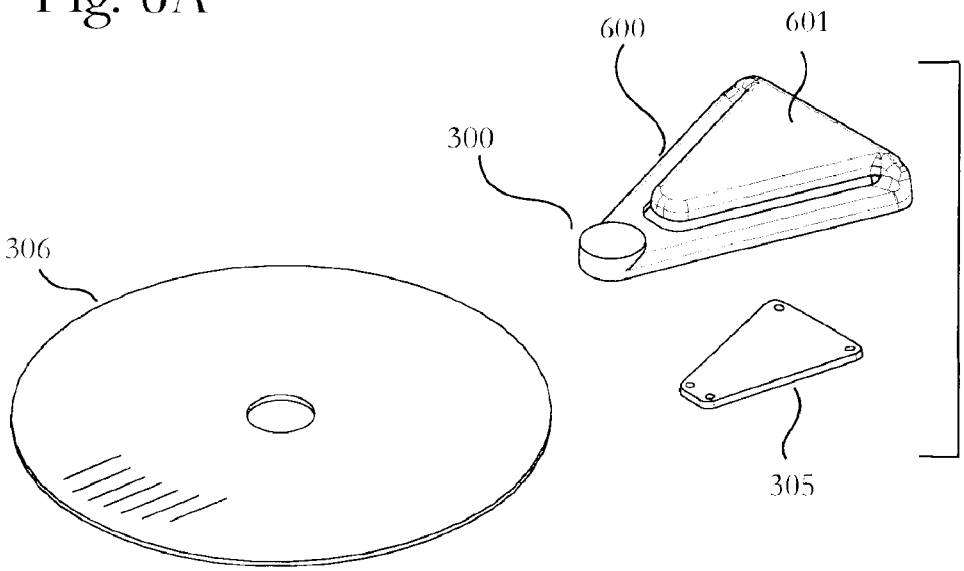
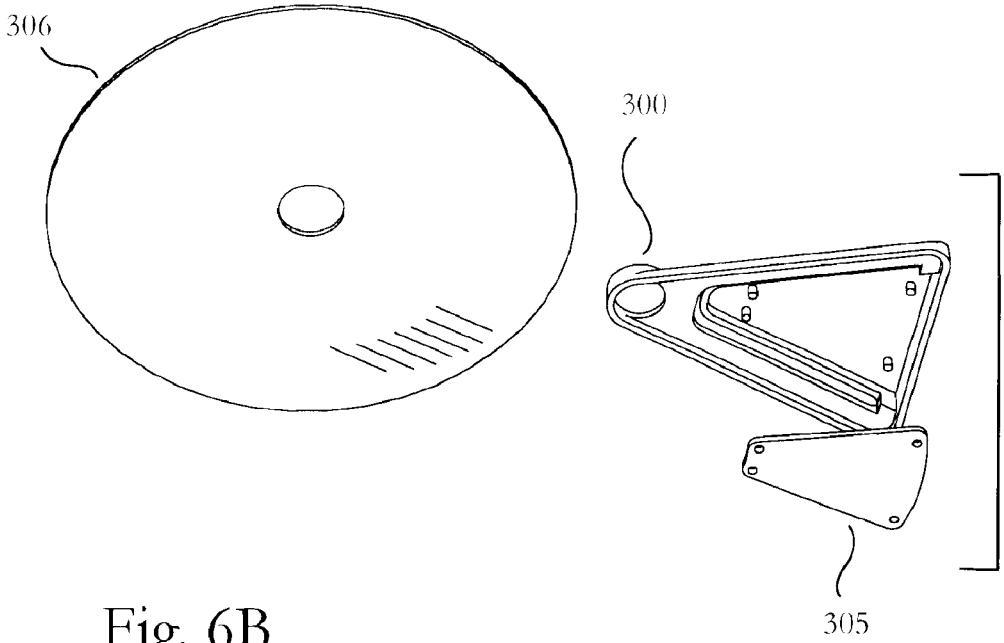
Fig. 6B

Fig. 7A
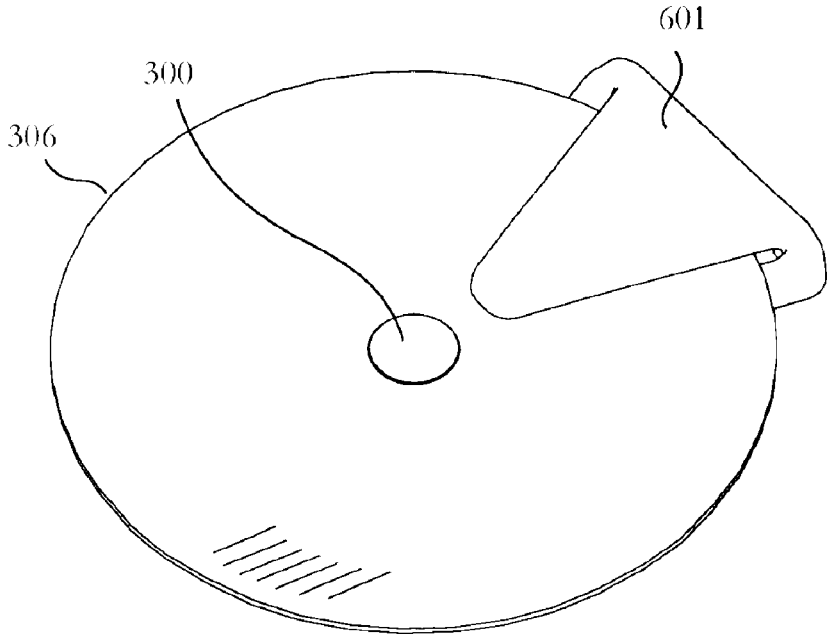
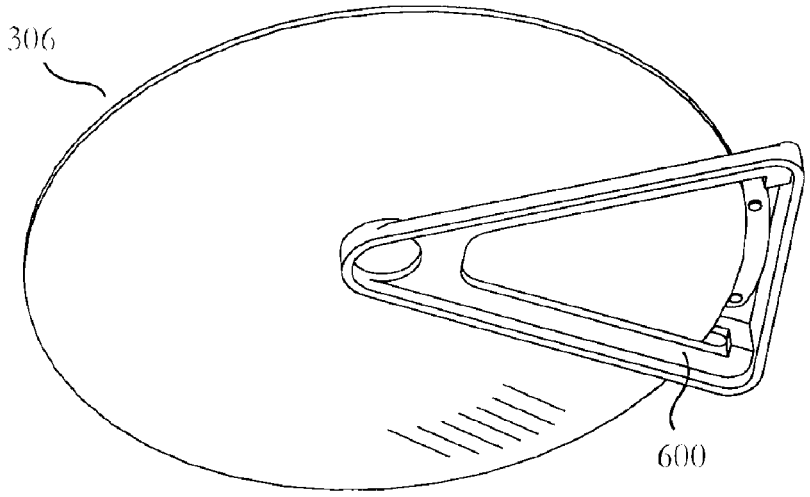
Fig. 7B

APPARATUS AND METHOD FOR DEGRADING THE INFORMATION BEARING CAPABILITIES OF A DISK

BACKGROUND OF INVENTION

1. Field of the Invention

Embodiments of the invention described herein pertain to the field of abrading. More particularly, these embodiments enable the abrading of a compact disk in order to destroy information contained therein.

2. Description of the Related Art

Information storage products in the form of compact discs are increasingly used to store sensitive information. This presents a problem when the information is no longer needed, namely, how to destroy the information so it can not be read again by other parties. In addition, the level of destruction required may differ for different users since government agencies and normal consumers have widely different standards as to what constitutes a disk that is considered unreadable. Persons wishing to throw away a disk are then left with the choice of method for destroying the disk. Methods include scraping the top of the disk with a sharp implement or fracturing the disk which tends to make the disk explode. These methods of destruction can be dangerous to the person destroying the disk or other collocated individuals.

In U.S. Pat. No. 5,954,569, a device is described that removes the information bearing surface of a compact disc. The device is constructed to meet government requirements for total destruction of the information carried on a compact disc. The device is too heavy, too expensive and destroys the information bearing surface of a disk to an extent far greater than required for a consumer based application. As listed in the specification, the device has a height of 8 inches, a depth of 10 inches and a width of 10 inches and a weight of 30 pounds. This device is directed towards government agencies requiring destruction of substrate down to 250 microns.

In U.S. Pat. No. 6,039,637, a device is described that removes the information bearing surface of a compact disc. The device is constructed to meet government requirements for total destruction of the information carried on a compact disc. The device is an improvement upon U.S. Pat. No. 5,954,569 in that it contains another chamber in which to even further reduce the size of the particulate material created by the initial scraping process. The device is heavier than the parent device discussed previously, too expensive and destroys the information bearing surface of a disk to an extent far greater than required for a consumer based application.

In U.S. Pat. No. Application Publication 20030006330 a paper shredder is supplemented with a third wheel that is used in order to break a compact disk or credit card. This device requires electrical power and is not easily transported due to its size and weight.

SUMMARY OF INVENTION

Embodiments of the invention abrade the surface of a compact disc in order to render it unreadable by standard consumer grade disk readers. This is accomplished via embodiments of the invention that are lightweight, highly portable and inexpensive.

In order to operate one embodiment of the invention, the apparatus is opened and a compact disc is inserted with the face of the disk against the abrasive mechanism. After closing the apparatus, the outer housing of the apparatus is rotated with sufficient pressure against the abrasive mechanism in order to cause the substrate to be damaged sufficiently to render it unreadable by consumer based disk readers. The apparatus can be opened over a trash bin in order to empty both the disk and the particulate matter generated by the abrasive process. The apparatus may be rotated by hand or by motor in various embodiments.

A case-less embodiment of the invention exists that comprises the abrasive mechanism and a post that fits into the center hole of the disk. Since there is no outer case coupled to the apparatus in this embodiment, the apparatus may be held over a trash bin while abrading the disk in order to dispose of the particulate matter resulting from the abrading process. In order to operate this embodiment, a disk is inserted into the opening between the abrader and post supporter and the post engages the hole in the center of the disk. The disk is then rotated in order to abrade the information bearing portion of the disk. When the disk has been abraded to the satisfaction of the user, the disk is disengaged from the post and the disk is removed and disposed of.

The term compact disc is used within this specification to refer to any disk that contains data such as, but not limited to compact disks, DVDs, audio disks, mini-disks and non-circular disks based on compact disk technology.

BRIEF DESCRIPTION OF DRAWINGS

FIG. 6A is a top perspective exploded view of an embodiment of the invention that has no outer case.

FIG. 6B is a bottom perspective view of FIG. 6A.

FIG. 7A is a top perspective view of an embodiment of the invention that has no outer case with a disk inserted.

FIG. 7B is a bottom perspective of FIG. 7A.

DETAILED DESCRIPTION

Figure 1:
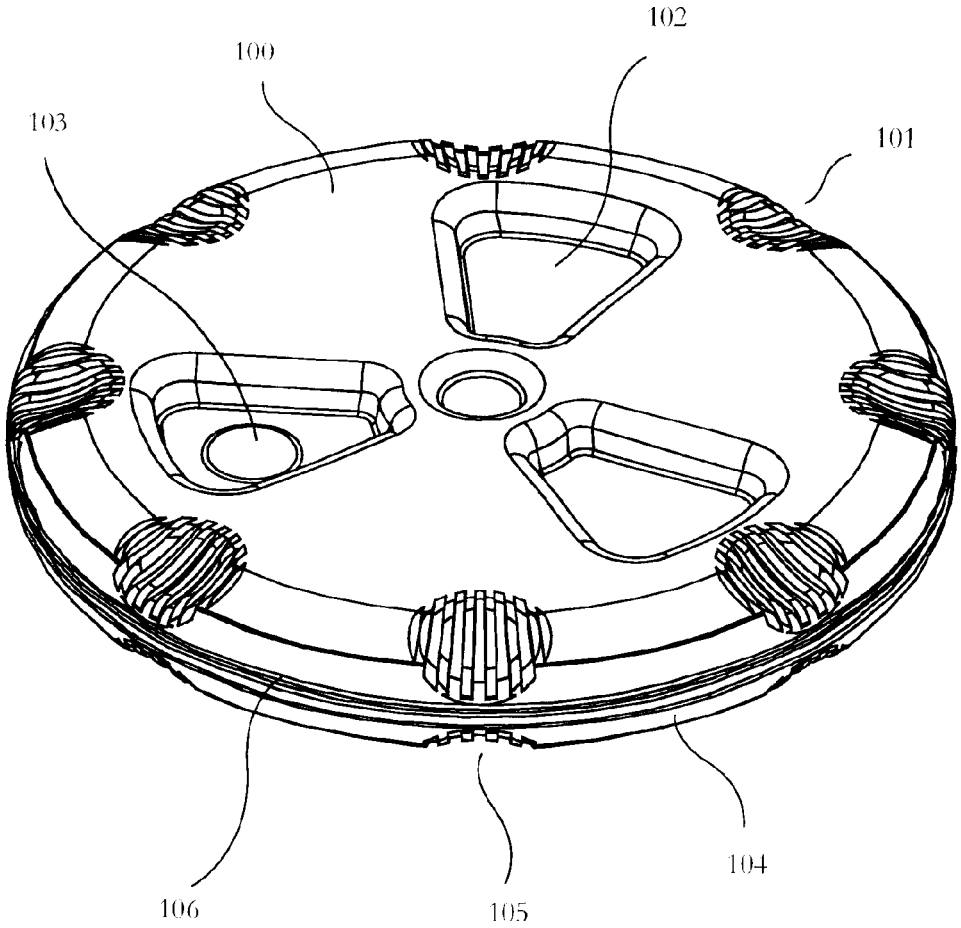
FIG. 1 is a perspective view of the top of an embodiment of the invention.

Embodiments of the invention abrade the surface of a compact disc, herein known as a "disk", in order to render it unreadable by standard consumer grade disk readers. FIG. 1 is a perspective view of the top of an embodiment of the invention. Case top 100 and case bottom 104 enclose a disk to be abraded and meet at case equator 106. FIG. 1 shows case top 100 and case bottom 104 engaged. In order to insert a disk into this embodiment, case top 100 and case bottom 104 are disengaged from each other. Embodiments of the invention may employ a hinge in order to keep case top 100 and case bottom 104 coupled during disengagement. Finger groove 101 and 105 are indentations that provides a user with a grip for rotating case top 100 with respect to case bottom 104. Embodiments of the invention exist without finger grooves and any mechanism that provides a non-slip surface may be used in place of finger grooves. Pad mount 102 is used in order to internally mount a pad against which a disk is placed and held in place with case top 100 as it rotates around case bottom 104. Ejector hole 103 is used in order to displace a disk from case top 100 when the abrading operation is terminated. Ejector hole 103 is typically situated in case top 100 and not in case bottom 104 since case bottom 104 holds the particulate matter generated from the abrading process. Therefore, when the case top and case bottom are separated after abrading a disk, case top 104 is emptied by pushing the disk out of case top 100 via ejector hold 103. Case bottom 104 is emptied by flipping case bottom 104 upside down over a trash bin. A person skilled in the art would readily recognize that case top and case bottom may be reversed by simply rotating the apparatus upside down, and therefore do not imply that the apparatus must be used in a particular configuration.

In order to operate an embodiment of the invention, the apparatus is opened at case equator 106 and a compact disc is inserted with the face of the disk against the abrasive mechanism. The disk snaps into place. The apparatus is closed, which engages the case top to the case bottom in a manner which allows the case top and case bottom to freely rotate. The outer housing of the apparatus is rotated with sufficient pressure against the abrasive mechanism in order to cause the substrate to be damaged sufficiently to render it unreadable by consumer based disk readers. The apparatus can be opened over a trash bin in order to empty both the disk and the particulate matter generated by the abrasive process. Ejecting the disk is accomplished via pushing into ejector hole 103.

Figure 2:
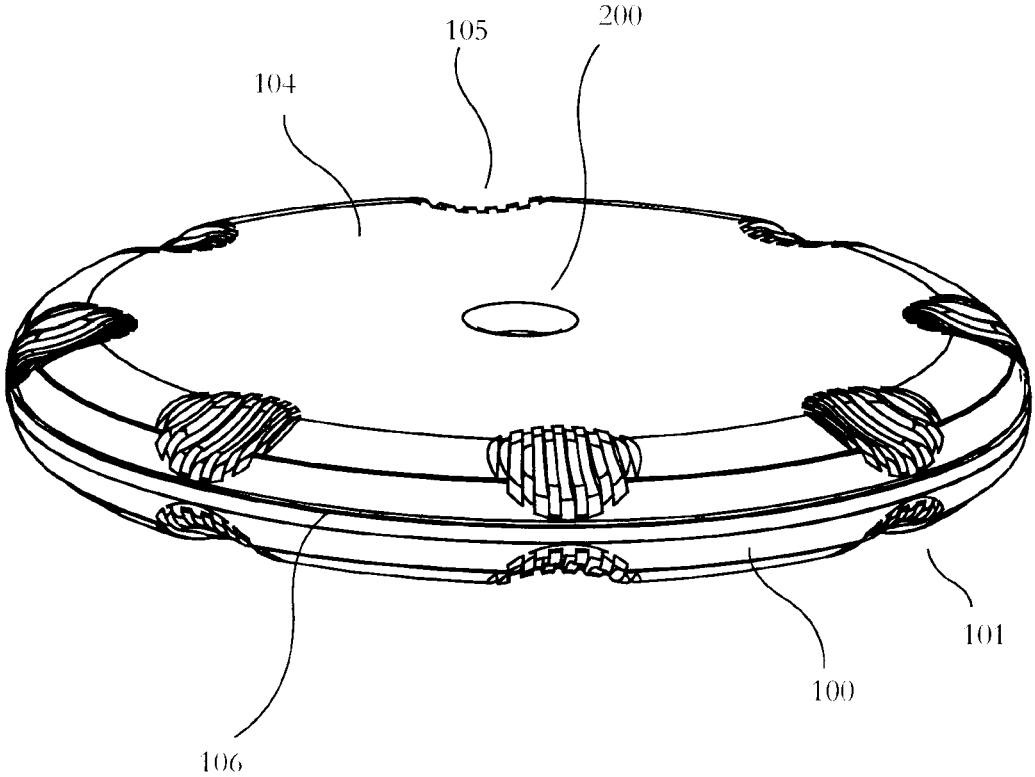
FIG. 2 is a perspective view of the bottom of an embodiment of the invention.

FIG. 2 is a perspective view of the bottom of an embodiment of the invention. Post indentation 200 can be seen in the center of the apparatus. This indentation is displaced to a corresponding female receptacle providing an axis on which case top 100 and case bottom 104 rotate about. In this embodiment of the invention the means for coupling the post to the abrader comprises coupling case top 100 to case bottom 104.

Figure 3:
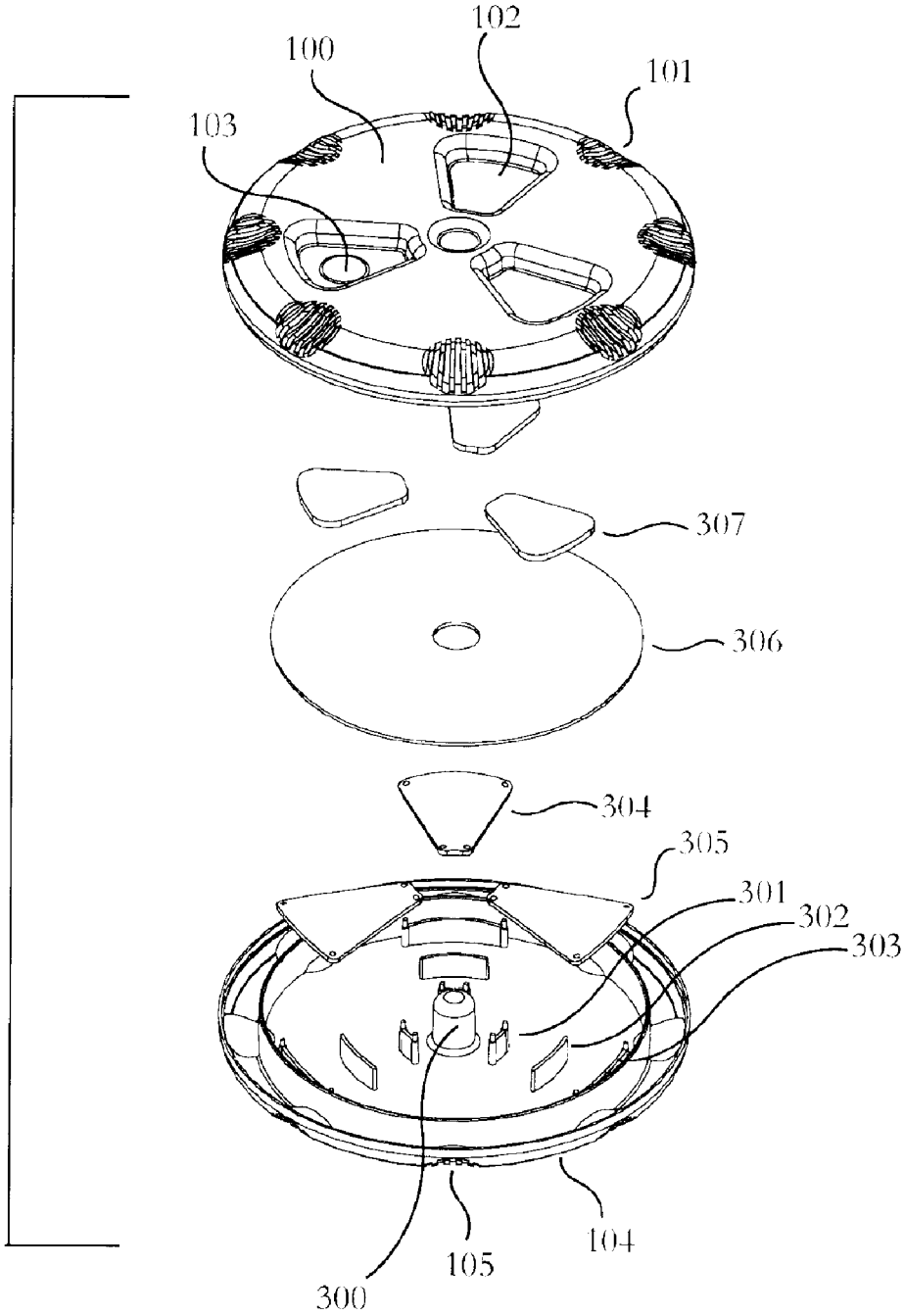
FIG. 3 is an exploded view of an embodiment of the invention as seen from the top perspective.

FIG. 3 is an exploded view of an embodiment of the invention as seen from the top perspective. Pad 307 acts to hold disk 306 in place while case top 100 and case bottom 104 rotate with respect to each other. An embodiment of the invention may employ one or more pad or any other element with a coefficient of static friction greater than either the coefficient of static or dynamic friction of the abrasive elements on the opposing side of disk 306. The word pad may or may not imply softness. Abraders 304 and 305 are shown beneath disk 306. Abrader 305 connects to abrader post 301, is supported by abrader support 302 and attaches to abrader post 303. Abrader posts 301 and 303 keep abrader 305 from rotating or moving away from disk 306 when pressure is place against disk 306 from the top direction. Abrader support 302 keeps abrader 305 from displacing down when pressure is placed against disk 306 from the top direction. Any mechanism that can be employed in which to keep the abraders of the system in place can be substituted for posts and supports. Post 300 is the top side of post indentation 200 as seen in FIG. 2. Post 300 fits into post guide 401 seen in FIG. 4.

Figure 4:
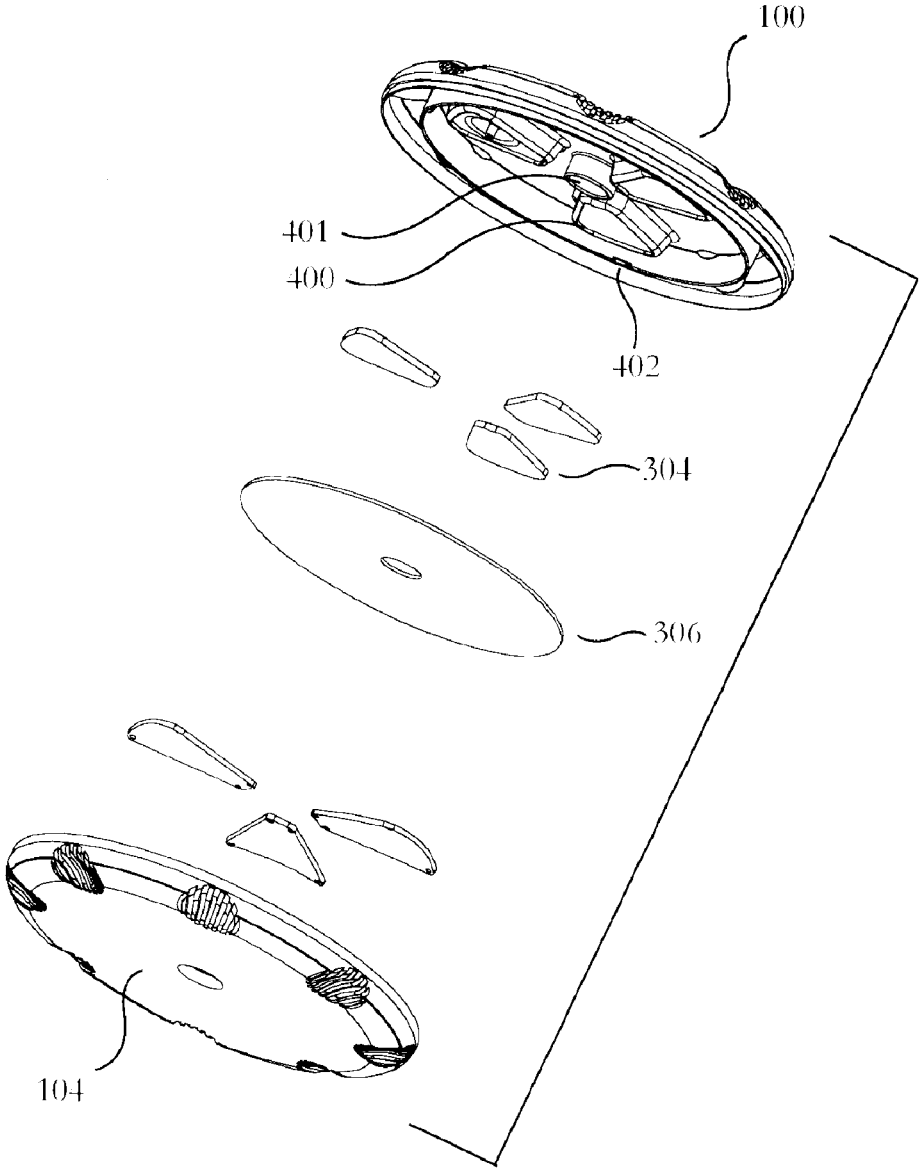
FIG. 4 is an exploded view of an embodiment of the invention as seen from the bottom perspective.

FIG. 4 is an exploded view of an embodiment of the invention as seen from the bottom perspective. Pad mount 400 is the inside of pad mount 102 seen in FIG. 1. Post 300 in FIG. 3 fits into post guide 401. Disk latch 402 prevents disk 306 from felling out until ejection hole 103 is utilized. Any mechanism that is configured to retain the disk in the device until ejection is desired may be substituted in place of disk latch 402. See FIG. 1 for location of ejection hole 103.

Figure 5:
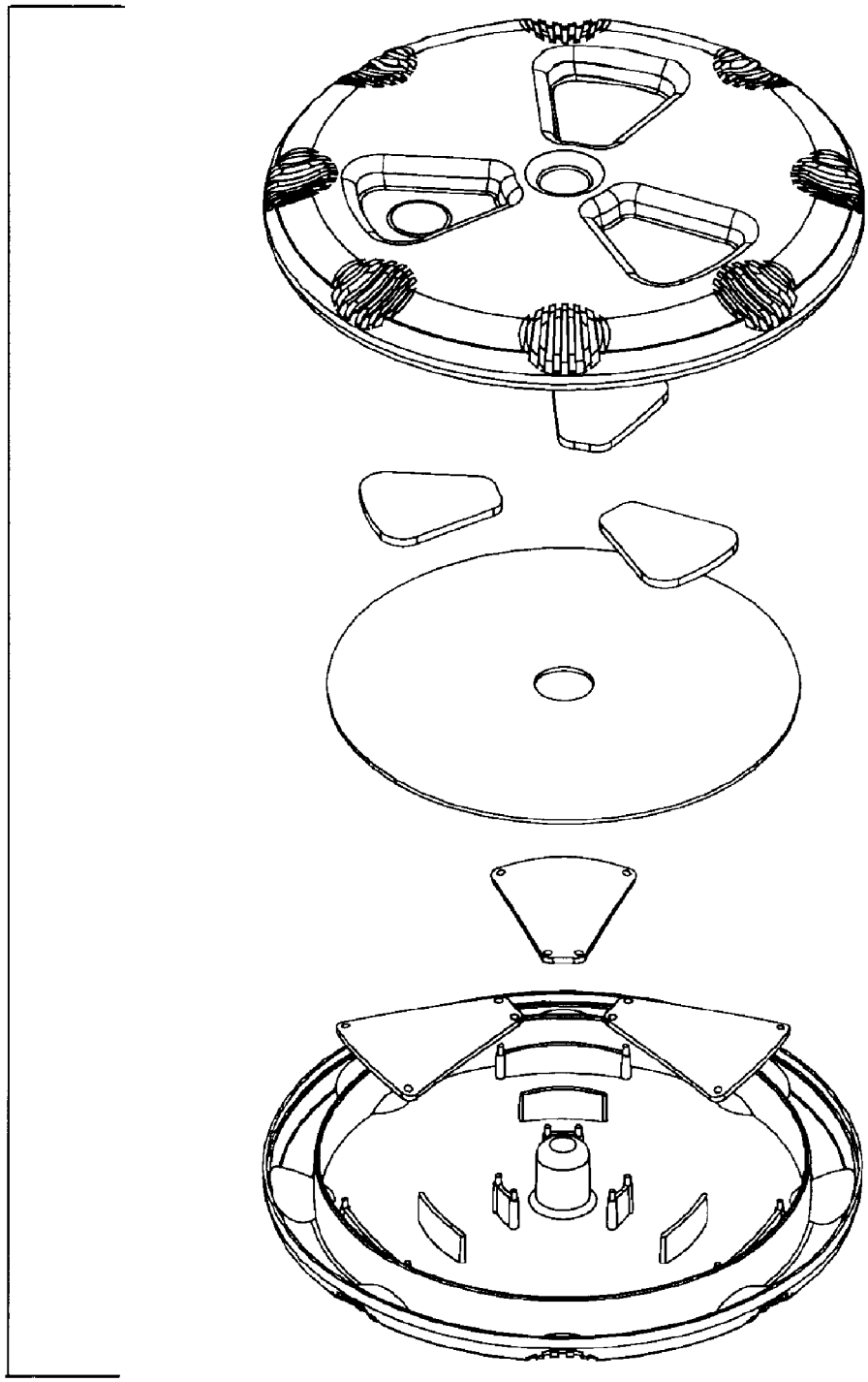
FIG. 5 is an exploded view of an embodiment of the invention as seen from the top perspective without the numbering and pointer lines.

FIG. 5 shows FIG. 3 without any lead lines or reference characters.

FIG. 6A is a top perspective exploded view of an embodiment of the invention that has no outer case. This embodiment may or may not be used over a trash bin. Abrader 305 is connected to abrader arm 601 which is connected to post support 600 which is connected to post 300. Disk 306 rides between post support 600 and abrader 305 when inserted into the apparatus. Rotating the disk with downward pressure on abrader arm 601 and upward pressure on post support 600 causes the substrate to be sufficiently damaged in order to render it unreadable on consumer disk readers. FIG. 6B shows the bottom perspective of FIG. 6A.

FIG. 7A is a top perspective view of an embodiment of the invention that has no outer case with a disk inserted. FIG. 7B is a bottom perspective of FIG. 7A. When a disk is inserted into this embodiment of the invention, the hole in the disk fits around post 300. As abrader arm 601 and post support 600 are forced together, sufficient pressure exists for abrasion to occur when the disk is rotated about post 300. In this embodiment of the invention the means for coupling the post to the abrader comprises abrader arm 601 and post support 600.

Figure 8:
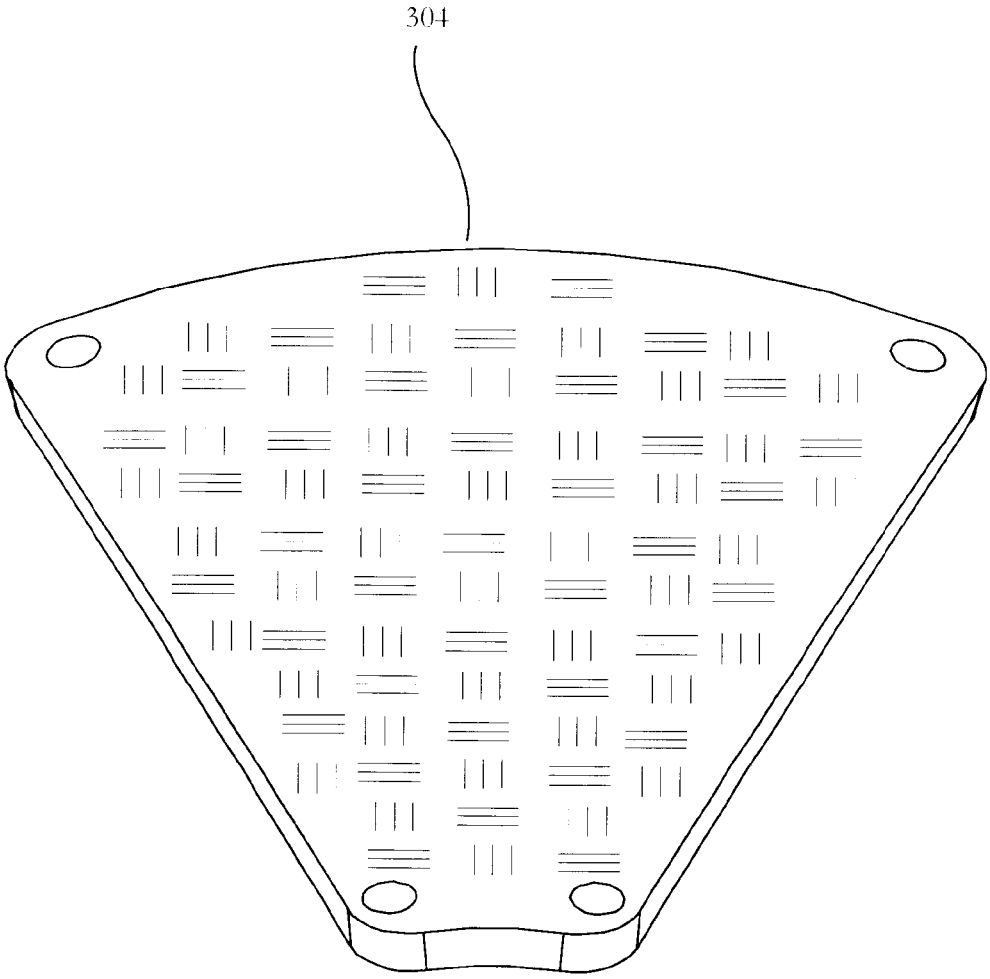
FIG. 8 is a close-up perspective view of an embodiment of an abrader.

FIG. 8 shows a perspective view of abrader 304. Any type of material that can successfully degrade the information bearing capability of a disk can be coupled to the abrader. This includes but is not limited to sand paper, grater elements and rasp teeth.

Thus embodiments of the invention directed to an apparatus and method for degrading the information bearing capability of a disk have been exemplified to one of ordinary skill in the art. The claims, however, and the full scope of any equivalents are what define the metes and bounds of the invention.

What is claimed is:

1. An apparatus for degrading the information bearing capability of a disk comprising:

at least one abrader;

a post configured to engage a disk hole; and, wherein said at least one abrader is coupled to said post wherein said at least one abrader is not coupled with an enclosing case and wherein said post is not coupled with an enclosing case.

2. An apparatus for degrading the information bearing capability of a disk comprising:

at least one abrader;

a post configured to engage a disk hole;

an inner case bottom cylinder;

a case bottom comprising said inner case bottom cylinder for securing particles abraded by said at least one abrader wherein said case bottom is coupled with said at least one abrader and said post;

at least one pad;

an ejector hole;

at least one disk latch;

an inner case top cylinder;

a post guide; and a case top comprising said ejector hole and said at least one disk latch coupled with said inner case top cylinder wherein said case top is formed to hold a disk inside said inner case top cylinder via said at least one disk latch wherein said disk is placed against said at least one pad wherein said case bottom and said case top are configured to rotate about an axis defined by said post and said post guide when said case bottom and said case top are engaged and form a second enclosed chamber comprising said inner case bottom cylinder and said inner case top cylinder and wherein said ejector hole forms an entryway into said second enclosed chamber that is blocked from said second enclosed chamber via said disk.

3. The apparatus of claim 2 wherein said case top and said case bottom further comprise a non-slip surface.

4. The apparatus of claim 3 wherein said non-slip surface comprises finger grooves.

5. The apparatus of claim 2 wherein said case bottom is configured to hold particulate not captured by said second enclosed chamber until said case top and said case bottom are disengaged.

6. A method for degrading the information bearing capabilities of a disk comprising:

placing a disk in a case top;

engaging said case top to a case bottom wherein said case top comprises an inner case top cylinder and said case bottom comprises an inner case bottom cylinder wherein said inner case top cylinder and said inner case bottom cylinder form a second enclosed chamber;

applying inward pressure to said case top and to said case bottom;

rotating said case top with respect to said case bottom;

abrading said disk.

7. The method of claim 6 further comprising:

disengaging said case top from said case bottom;

ejecting said disk via an ejector hole that forms an entryway into said second enclosed chamber that is blocked from said second enclosed chamber via said disk; and, emptying said case bottom of particulate.

8. An apparatus for degrading the information bearing capability of a disk comprising:

an abrader;

an abrader arm;

a post support; and, a post coupled with said post support coupled with said abrader arm coupled with said abrader configured to abrade a disk placed against said abrader when said disk is placed on said post and rotated about an axis defined by said post and wherein said apparatus is not configured to capture particles in a case wherein said particles result from abrasions of said disk.

9. A method for degrading the information bearing capabilities of a disk comprising:

placing a disk against an abrader;

coupling said disk to a post wherein said at least one abrader is not coupled with an enclosing case and wherein said post is not coupled with an enclosing case;

applying inward pressure to a post support and said abrader;

rotating said disk about an axis defined by said post;

abrading said disk.

10. The method of claim 9 further comprising:

decoupling said disk from said post; and disposing of said disk.

11. An apparatus for degrading the information bearing capability of a disk comprising:

means for placing a disk in a case top;

means for engaging said case top to a case bottom wherein said case top comprises an inner case top cylinder and said case bottom comprises in inner case bottom cylinder wherein said inner case top cylinder and said inner case bottom cylinder form a second enclosed chamber;

means for applying inward pressure to said case top and to said case bottom;

means for rotating said case top with respect to said case bottom; and, means for abrading said disk.

12. The apparatus of claim 11 further comprising:

means for disengaging said case top from said case bottom;

means for ejecting said disk via an ejector hole that forms an entryway into said second enclosed chamber that is blocked from said second enclosed chamber via said disk; and, means for emptying said case bottom of particulate.

13. An apparatus for degrading the information bearing capability of a disk comprising:

means for placing a disk against an abrader;

means for coupling said disk on a post wherein said at least one abrader is not coupled with all enclosing case and wherein said post is not coupled with an enclosing case;

means for applying inward pressure to a post support and said abrader;

means for rotating said disk about an axis defined by said post;

means for abrading said disk; and, means for decoupling said disk from said post.

* * * * *